United States Patent [19]

Petrini Poli

[11] 4,187,991

[45] Feb. 12, 1980

[54] UNLOADING

[75] Inventor: Denis Petrini Poli, Chatou, France

[73] Assignee: Babbitless, Paris, France

[21] Appl. No.: 937,526

[22] Filed: Aug. 28, 1978

[30] Foreign Application Priority Data

Sep. 8, 1977 [FR] France ..... 77 27214

[51] Int. Cl.[2] ..... B02C 2/00

[52] U.S. Cl. ..... 241/33; 241/207; 241/231

[58] Field of Search ..... 241/33, 34, 207, 231

[56] References Cited

FOREIGN PATENT DOCUMENTS

| | | | |
|---|---|---|---|
| 861490 | 1/1953 | Fed. Rep. of Germany | 241/33 |
| 2307023 | 8/1974 | Fed. Rep. of Germany . | |
| 157824 | 2/1957 | Sweden | 241/33 |
| 715806 | 9/1954 | United Kingdom | 241/33 |

*Primary Examiner*—Robert L. Spicer, Jr.
*Attorney, Agent, or Firm*—Owen, Wickersham & Erickson

[57] ABSTRACT

In the case of overloading of a gyratory crusher the manometer 14 detects a mean effective pressure of the hydraulic fluid in the cylinder 7 greater than a first limiting value, which causes the opening of the maximum pressure valve 18. The hydraulic fluid then flows into the hydraulic accumulator 22, previously filled with a gas at a pressure substantially equal to the said first limiting value. When the overloading is terminated, the maximum pressure valve 18 re-closes and the hydraulic fluid returns by the return branch 24 into the pressure chamber of the cylinder 7. In the case of very substantial overloading capable of damaging the apparatus, the manometer 26 causes the opening of the safety valve 29.

9 Claims, 1 Drawing Figure

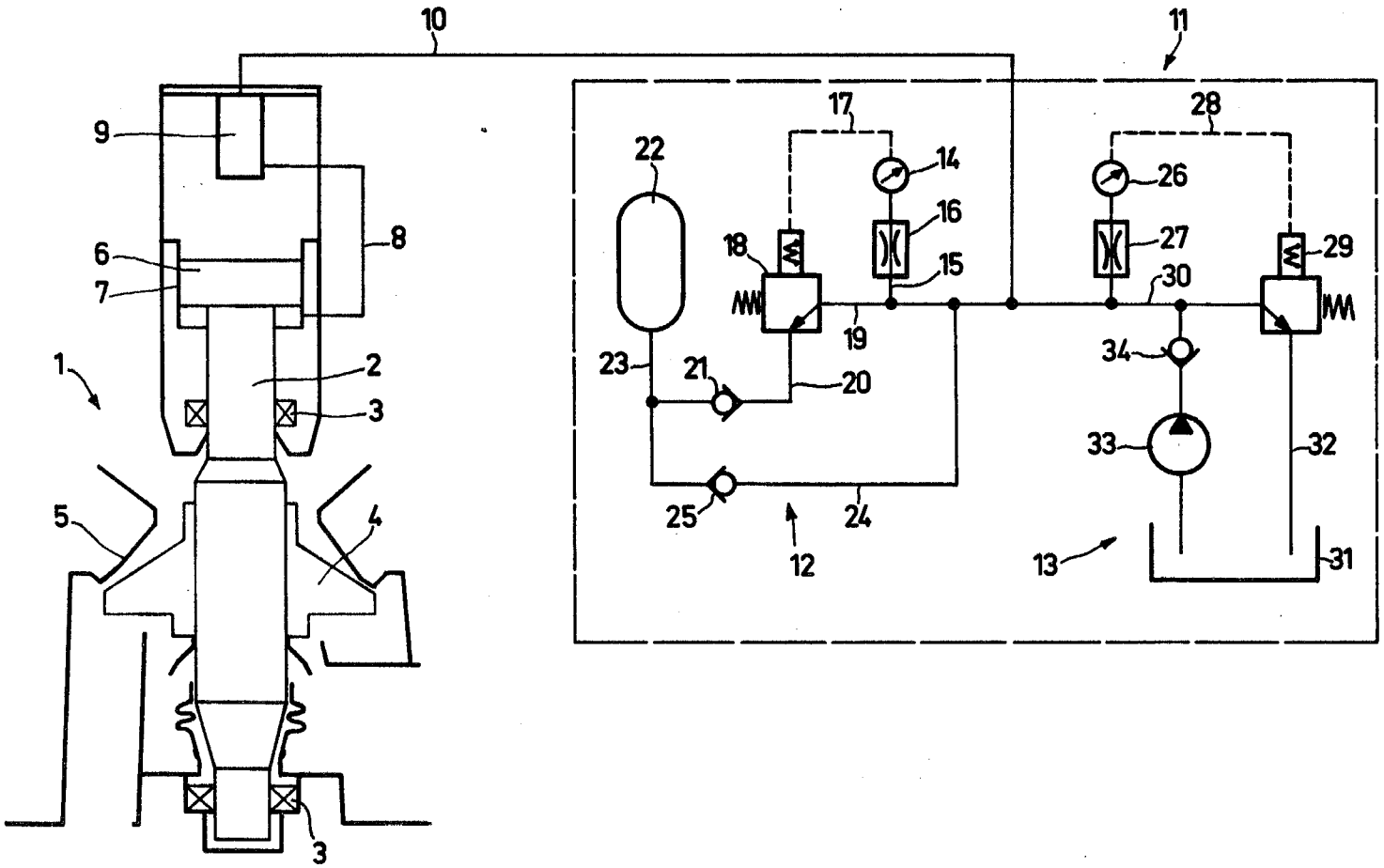
1
2
3
4
5
6
7
8
9
10
11
12
13
14
15
16
17
18
19
20
21
22
23
24
25
26
27
28
29
30
31
32
33
34

UNLOADING

The present invention relates to unloading devices intended to relieve the crushing hub of a gyratory crusher in the case of overloading, due for example to clogging in the crushing container.

Gyratory crushers are apparatus functioning in a continuous manner, in contrast for example to jaw crushers which carry out sequential operations. The forces exerted on the different components of a gyratory crusher are themselves substantially continuous, with the result that, for a given weight, gyratory crushers have as is known superior performances over jaw crushers.

Gyratory crushers rotating at relatively great speeds produce from this fact a considerable work and are particularly sensitive to overloading due particularly to clogging or to passage of practically incompressible metal pieces. Clogging can particularly occur during the passage of a certain amount of material of fine grain coming from the residue of a charge in the feed hopper. These fine particles are practically incompressible, and cause a substantial transient overloading on the crushing hub of the gyratory crusher, which may produce results in operation which can even extend to breakage of components.

To overcome these difficulties, it has already been envisaged to mount resiliently one of the elements of a gyratory crusher, that is to say either the fixed crushing ring, or the movable crushing hub, by means of a device which can be mechanical or hydraulic. To avoid all vibratory phenomena, the resilient device is pre-stressed to a loading value which is greater than the mean pressure of crushing of the crusher. The threshold of loading is an experimental quantity, which is difficult to determine and which, for reasons of safety, is in general chosen to be pretty close to the mean crushing force, so as to ensure a suitable resilient unloading of the crushing hub relative to the fixed crushing ring before overloading occurs. These devices may be made in the form of pre-stressed springs by means of which one of the components of the gyratory crusher is mounted.

In the frequent case in which the crushing hub of the crusher is held in position by the pressure of a hydraulic fluid exerted on a piston fixed to the shaft of the hub, placed either on the upper part of the shaft or on the lower part, one can likewise achieve resilient mounting by making the pressure chamber of the supporting cylinder communicate with a hydraulic accumulator loaded to a convenient pressure greater than the mean pressure of crushing.

In all these cases, these resilient unloading devices have the inconvenience of producing a crushed material of which it is not possible to guarantee a constant grain size, because every overloading, even a slight one, causes a displacement of the crushing hub relative to the crushing ring, bringing about passage of partially crushed material of larger grain size.

If, to avoid this phenomenon, one chooses a greater pre-stressing value of the resilient device, one then practically eliminates the advantage which has been looked for by the addition of the resilient unloading device, since choking can then bring about an overloading capable of damaging the gyratory crusher.

To ensure a constant grain size of the material obtained after crushing, the applicants have already produced gyratory crushers in which the components are maintained rigidly in position relatively to one another, no resilient unloading device being provided.

It is then desirable to dimension the principal components in such a way that their strength shall be sufficient to sustain the supplementary forces due to possible overloading.

To avoid, however, accidental damage to such a gyratory crusher, the applicants have also already envisaged (French Pat. No. 1 348 513) adding to such rigid devices a safety system bringing about a non-reversible unloading of the crushing hub by opening of a controlled valve and discharge into a holding vessel.

After a predetermined time corresponding to the passage of the incompressible body, a pump is activated to re-supply the supporting piston for the crushing hub.

In the case in which the gyratory crusher includes, as previously indicated, hydraulic means of support for the crushing hub, the safety device can include a pressure detector, conveniently damped, which causes the hydraulic circuit to be vented to atmosphere when the mean operating pressure passes a safety limiting value fixed experimentally.

With such a device it is then possible to obtain a rigid operation ensuring constant grain size of the product resulting from the crushing, and safety in the case of accidental overload.

Despite the advantage resulting from the regularity of the grain size obtained, such a device however presents grave inconveniences. In fact it necessitates a substantial increase in dimension of the components of the gyratory crusher in order to ensure a suitable strength during irregular forces. To limit the dimensions, one is driven to bring the limit of safety close to the value of the mean crushing pressure, which brings about more and more frequent safety stopping, each of these stops having notably as a consequence temporarily permitting the passage of a portion of uncrushed material after the safety separation of the crushing hub relative to the fixed ring.

U.S. Pat. Nos. 2,799,456 and 3,057,563 describe devices for automatic unloading of the crushing hub of a gyratory crusher maintained in position by hydraulic supporting means. In these devices of known type, it is possible to have a compromise of the advantages of a rigid support and those of a resilient support. In fact the hydraulic device includes a hydraulic accumulator loaded by charging with a gas at high pressure. The hydraulic fluid used for support can enter the accumulator and compress the gas, when a valve is operated in response to the pressure of the hydraulic supporting fluid exceeding a predetermined limiting value, that is to say in the case of transient overloading.

In these devices of the prior art, it is however necessary to provide means for pumping the hydraulic fluid from a reservoir, so as to compensate for the losses of hydraulic fluid each time that, by reason of an overloading, a certain quantity of hydraulic fluid enters the accumulator. When the pressure of fluid declines, the valve which put the supporting piston of the crushing hub into communication with the accumulator re-closes, in fact in such a way that a substantial part of the hydraulic fluid remains imprisoned in this accumulator. In order that the crushing hub shall return to its normal position it is thus necessary to re-supply the said hydraulic fluid, the position of the shaft carrying the crushing hub being adjusted by a position detector.

The object of the present invention is to simplify considerably the automatic discharge devices of the prior art, while ensuring on the one hand a rigid positioning of the crushing components relatively to one another in normal operation, thus creating the conditions necessary to obtaining the desired constant grain size, and on the other hand permitting, solely in the case of overloading due for example to a clogging phenomenon, the resilient positioning of the said crushing components, making possible the temporary and reversible displacement of one of the two crushing components, notably the hub, without making necessary stoppage of the apparatus.

The invention also has as its object a hydraulic discharge device in which the quantity of hydraulic fluid is maintained constant thus ensuring the maintenance of a suitable position of the crushing hub.

The automatic unloading device for the crushing hub of a gyratory crusher according to the invention is adapted to such a crusher in which the crushing hub is fixed to a shaft maintained in position by the pressure of a hydraulic fluid. The device according to the invention comprises a first detector measuring the mean value of a critical parameter of operation of the crusher. This first detector is capable of causing, wherever the measured value of this critical parameter exceeds a first limit, greater than the mean operating value of the said parameter during operation of the crusher, the opening of a valve with automatic closure, permitting communication of the hydraulic fluid with a hydraulic accumulator which is empty of hydraulic fluid in the normal conditions of operation. According to the invention, the accumulator is loaded to a pressure equal to that which exists during the operation of the crusher corresponding to the said first limit of the critical parameter, and the circuit for resilient unloading includes a branch provided with a non-return valve for the return of hydraulic fluid coming from the accumulator when the said valve is re-closed.

The device according to the invention also comprises preferably safety unloading means comprising a second detector likewise measuring the mean value of the said critical parameter and capable of causing, when the measured value of the said parameter exceeds a second limit greater than the said first limit, the opening of a safety valve bringing about the discharge of the hydraulic fluid into a reservoir.

The critical parameter chosen to define the operation of the crusher can be, for example, the pressure of the hydraulic fluid supporting the crushing hub in position, or the power effectively absorbed by the crusher, or any other parameter providing an indication of the operation of the crusher.

In a preferred embodiment, the critical parameter is the pressure of the hydraulic fluid. In this case, the first detector of the device according to the invention measures the mean pressure of the said hydraulic fluid and controls a valve in the hydraulic circuit. The accumulator is then loaded to a pressure substantially equal to the limiting value of the pressure which causes the opening of the said valve.

The valve is preferably controlled electro-magnetically by a pressure switch associated with a damping device. A non-return valve is also mounted between the valve and the accumulator so as to protect the valve by preventing the passage of hydraulic fluid from the accumulator in the direction of the said valve.

In this embodiment, the second detector likewise measures the mean pressure of the hydraulic fluid.

The first value of the pressure, which thus constitutes the first limit causing the gyratory crusher to pass from a rigid operation to a resilient operation, is chosen for preference very close to the normal operating pressure of the apparatus. Excellent results may be obtained by choosing the first limiting value of the measured pressure greater by about 5 to 10 bars than the mean operating pressure of the crusher. The second limiting value of the measured pressure which causes the putting into operation of the safety unloading circuit, that is to say a non-reversible displacement of the crushing hub, necessitating the stopping of the apparatus and a subsequent action, for example by means of a hydraulic pump, for putting back into operation, may on the contrary be chosen very much greater than the mean operating pressure of the apparatus. Excellent results may be obtained by choosing this second value greater by about 30 to 40 bars than the mean operating pressure of the crusher.

In another embodiment, where the critical parameter chosen is the power absorbed by the crusher, the different detectors mentioned above may be electric measuring apparatus such as watt meters or ammeters, inserted in the electric supply circuit for the driving motor of the crusher and connected to different valves placed in the hydraulic circuit so that they open when the measured values exceed the predetermined limits.

The invention will be better understood from the study of a particular embodiment described in a wholly non-limiting manner and illustrated by the accompanying drawing which shows very schematically the essential components of a gyratory crusher and the hydraulic circuit of a device according to the invention, in which the critical parameter chosen is the pressure of the hydraulic fluid.

As is shown in the single FIGURE in an extremely schematic manner, the gyratory crusher 1 comprises a shaft 2 supported between bearings 3 and including a crushing hub 4, the upper surface of which is substantially conical. The materials to be crushed are introduced above the crushing hub 4 between the conical surface of the latter and an opposed conical surface of a fixed crushing ring 5 defining with the crushing hub 4 a passage contracting downstream, the one wall of which constituted by the crushing hub 4 is driven with an eccentric movement via the shaft 2 which is slightly inclined with respect to the vertical axis of the crusher assembly 1. This is indicated schematically by the difference in separation at right and left of the shaft 2 between the crushing hub 4 and the fixed crushing ring 5.

The upper part of the shaft 2 includes a piston 6 mounted in a cylinder 7. The side of the cylinder 7 towards the shaft is filled with a hydraulic fluid subjected to such a pressure that it produces the axial location and support of the shaft 2 and of the crushing hub 4 which is rigid with it. The pressure chamber of the cylinder 7 is connected by a line 8 to a rotary gland 9 which is in turn connected by a line 10 to a hydraulic control circuit 11 which is the subject of the present invention. This hydraulic circuit comprises on the one hand a circuit 12 causing the reversible resilient unloading of the crushing hub 4, and on the other hand a safety circuit 13 causing a non-reversible safety unloading.

The hydraulic circuit 12 comprises a first detector of the mean pressure of the hydraulic fluid coming from the rotary gland 9, this detector being constituted by a manometer 14 supplied with hydraulic fluid by the line 15 through a damping device 16 which, in the example shown, is schematically represented in the form of a restrictor. The manometer 14 can be of the mechanical type constituted for example by a flattened tube in a spiral damped hydraulically by means of a needle. The manometer 14 includes means (not shown) for closing electric contacts, constituting a pressure switch. This switch is connected electrically by the connection 17 to the control solenoid of a normally-closed valve 18 controlled electromagnetically and with resilient return.

It will of course be understood that the manometer 14 could without difficulty be replaced by an electrical device such as a piezoelectric detector providing a signal which is suitably filtered by means which are likewise electrical, replacing the damper 16. The essential is that these means permit measuring continually the mean pressure of the hydraulic fluid in the pressure chamber of the cylinder 7 of the crusher 1, without taking account of possible instantaneous fluctuations resulting from the irregular forces exerted on the crushing hub 4.

The hydraulic circuit 12 includes a first direct branch constituted by lines 19 and 20. The pressure detector constituted by the manometer 14 measures the pressure in the line 19, and the valve 18 is capable of perfectly tight interrupting the flow between the lines 19 and 20 in its normal condition or permitting this flow when it is actuated by the pressure switch associated with the manometer 14. A non-return valve 21 is arranged in the line 20 downstream of the valve 18 so as to protect the latter. A hydraulic accumulator 22 loaded to a first value of pressure is connected by a line 23 to the direct branch 19, 20 of the hydraulic circuit 12. The non-return valve 21 is arranged so as to allow passage of fluid only towards the accumulator 22, preventing all return from the accumulator 22 towards the valve 18.

The hydraulic circuit 12 also comprises a return branch 24 connecting the hydraulic accumulator 22 to the line 19 upstream of the manometer 14. A non-return valve 25 is arranged in the return branch 24 so as to permit the passage of fluid only away from the accumulator 22.

It is essential for the requirements of the present invention that the accumulator 22, in normal operation when the maximum pressure valve 18 is closed, should be totally empty of hydraulic fluid. In the example shown, the accumulator, in normal operation, is entirely filled with a gas such as air or preferably a non-reactive gas such as nitrogen, at a pressure substantially equal to the said first value of pressure, the gas thus producing the loading of the accumulator. It will be understood that other means could easily be envisaged for obtaining this loading.

The safety unloading circuit 13 comprises a second pressure detector constituted by a second manometer 26 and damping device 27 and including a pressure switch not shown in the FIGURE. The structure of the manometer 26 and of the damper 27 can be identical to those of the manometer 14 and the damper 16 of the first hydraulic circuit 12. Likewise the manometer 26 may be of the mechanical type damped hydraulically by a needle or be replaced by entirely electric means.

In all these cases the detector, constituted in the example shown by the manometer 26 associated with the damper 27, measures the mean pressure prevailing in the hydraulic fluid in the pressure chamber of the cylinder 7. The manometer 26, like the manometer 14, comprises means permitting regulation of the mean value of the limiting measured pressure above which the pressure switch which is associated with its closes, thus sending an electrical control signal through the connection 28 to the control solenoid of the safety valve 29, which may be controlled electromagnetically and identical with the valve 18.

The manometer 26 is branched from a line 30 upstream of the safety valve 29, which is capable of interrupting in a perfectly tight manner the flow of fluid, or of letting the hydraulic fluid pass when it has received a control pulse from the manometer 26. In open position, the valve 29 permits the passage of the hydraulic fluid through a discharge line 32, in the direction towards a reservoir 31 which can be, for example, at atmospheric pressure.

A pump 33 protected by a non-return valve 34 permits feeding the pressure chamber of the cylinder 7 with hydraulic fluid from the reservoir 31, via the line 30 and the line 10.

The device as shown functions in the following manner:

The manometer 14 is adjusted to a limiting mean pressure about 5 to 10 bars above the mean operating pressure of the gyratory crusher. The accumulator 22 is loaded to the same pressure by being totally filled with gas. The manometer 26 is adjusted to a value of limiting mean pressure equal on the contrary to a value about 30 to 40 bars above the mean operating pressure of the crusher.

In these conditions, during crushing by eccentric movement of the crushing hub 4 in the interior of the fixed ring 5, in normal operation, the two valves 18 and 29 are closed tightly, the accumulator 22 is empty of hydraulic fluid, and everything happens as if the shaft 2 were supported rigidly by the incompressible hydraulic fluid present in the pressure chamber of the cylinder 7. The position of the crushing hub is determined by the volume of the hydraulic fluid in the cylinder 7. The valves 18 and 29 being perfectly tight in the closed position, this volume of fluid is thus perfectly constant. One obtains a crushing action ensuring a constant grain size.

If a substantial overload occurs, due for example to clogging or to the passage of a metal piece into the crushing space, the mean pressure measured by the manometer 14 may exceed the limiting value determined for this manometer. In this case, and whenever this value is passed, the pressure switch associated with the manometer 14 issues a control signal which causes the opening of the valve 18. The hydraulic fluid from the pressure chamber of the cylinder 7 can then flow through the line 10 and the direct branch 19, 20 and enter the hydraulic accumulator 22, which causes an increase in the pressure of the gas trapped in the accumulator, or the compression of a spring device which it contains. It will be noted that a small quantity of hydraulic fluid entering the accumulator 22 is sufficient to unload temporarily and in a reversible manner the crushing hub 4, which undergoes a slight movement downwards permitting the passage of the material which has caused the overload. As soon as the overload is finished, the valve 18 re-closes automatically under the action of its resilient return spring. The hydraulic fluid contained in the accumulator 22 can then return by the return branch 24 and the non-return valve 25 into the pressure chamber of the cylinder 7. The total amount of the hydraulic fluid which has entered into the accumulator 22 is returned by the latter into the hydraulic circuit, thanks to the initial loading of the accumulator 22 to a pressure substantially equal to the limiting value set on the manometer 14. Granted the absence of leakage in the valve 18 and this total recovery of the accumulator 22, the crushing hub returns exactly to its initial position determined by the volume of hydraulic fluid in the pressure chamber of the cylinder 7.

One thus obtains in this way a resilient unloading, which is totally reversible, of the crushing hub 4, which does not interrupt at all the operation of the apparatus and which occurs only in the case of overloading, the crusher remaining rigidly mounted in normal operation.

In the case in which the mean pressure of the hydraulic fluid exceeds the second value set on the manometer 26, the latter then intervenes, causing, via the pressure switch which is associated with it, the emission of an electric signal controlling the opening of the safety valve 29. The hydraulic fluid can then flow freely in the direction towards the reservoir 31. This action causes a safety non-reversible unloading of the crushing hub 4, the said safety unloading being advantageously combined with means, not shown in the FIGURE, causing stopping of operation of the apparatus.

In order to put the crusher back into operation, after the unloading safety circuit has thus functioned, it is necessary to re-supply the pressure chamber of the cylinder 7 with hydraulic fluid by means of the pump 33.

The valves 18 and 29 which have been described may be of any type, on condition that they do not provide appreciable leakage. Thus one can use differential pressure electro-valves or preferably electro-valves comprising a differential piston with compensating pressure, the return of which is produced by a return spring.

The present invention permits production of a gyratory crusher ensuring the obtaining of rapid and effective crushing. It likewise permits one in normal operation to obtain, thanks to rigid mounting, a constant grain size of the product. Finally, thanks to the existence of the resilient unloading circuit, coming into operation only in the case of overloading, and temporarily, one also obtains a continuous operation and a temporary reversible displacement of the crushing hub, the overloadings normally not involving stopping the operation of the crusher.

It is clear that the invention is applicable also to a gyratory crusher in which the hub is fixed and the crushing ring is movable.

I claim:

1. In a gyratory crusher incorporating a crushing hub fixed to a shaft, and means adapted to be actuated by hydraulic fluid and thereby hold said shaft in position, an improved automatic unloading device comprising a hydraulic accumulator normally empty of hydraulic fluid and loaded to a predetermined pressure, a first line and a second line each between said means and said accumulator, a first normally-closed valve in said first line, a first detector adapted to measure the mean value of a critical operating parameter of the crusher, and to cause opening of said valve whenever the measured valve exceeds a first determined limit, said limit being greater than the mean value of said parameter during normal operation of the crusher, and said predetermined pressure being substantially equal to that which exists in said means when said parameter is at said first limit, and a non-return valve in said second line, adapted to open towards said means.

2. A device according to claim 1, wherein said accumulator is entirely filled with a gas at said predetermined pressure.

3. A device according to claim 1, comprising also a reservoir, a third line between said means and said reservoir, a second normally-closed valve in said third line, and a second detector adapted to measure the mean value of said parameter, and to cause opening of said second valve when the measured value exceeds a second predetermined limit, greater than said first limit.

4. A device according to claim 3, wherein said parameter is the pressure of the hydraulic fluid in said means.

5. A device according to claim 4, wherein said first valve is controlled electromagnetically, said first detector is a pressure switch associated with a damping device, and there is a further non-return valve between said first valve and said accumulator, preventing the passage of fluid from the accumulator in the direction of said first valve.

6. A device according to claim 4, wherein said second detector is a pressure switch associated with a damping device.

7. A device according to claim 4, wherein said first limit is greater by about 5 to 10 bars than the mean operating pressure of the crusher, while said second limit is greater by about 30 to 40 bars than the mean operating pressure of the crusher.

8. A device according to claim 3, wherein said parameter is the energy absorbed by the crusher, the said detectors being electrical measuring apparatus inserted in the electrical supply circuit for the driving motor.

9. A device according to claim 1, in a gyratory crusher in which the hub is fixed and a crushing ring is movable.

* * * * *